US005351751A

United States Patent [19]

Cage et al.

[11] Patent Number: 5,351,751

[45] Date of Patent: Oct. 4, 1994

[54] HEAT EXCHANGER TANK WITH TIE BAR

[75] Inventors: Lynn L. Cage, Warren, Pa.; Rodney A. Spears, Forestville; Lawrence R. Barron, Jr., Jamestown, both of N.Y.

[73] Assignee: Valeo Engine Cooling, Incorp., Jamestown, N.Y.

[21] Appl. No.: 116,033

[22] Filed: Sep. 2, 1993

[51] Int. Cl.[5] ..... F28F 9/02

[52] U.S. Cl. ..... 165/173; 165/906

[58] Field of Search ..... 165/149, 173, 906; 403/409.1, 374

[56] References Cited

U.S. PATENT DOCUMENTS

| | | | |
|---|---|---|---|
| 4,331,201 | 5/1982 | Hesse | 165/149 X |
| 4,401,157 | 8/1983 | Cadars | 165/173 |
| 5,107,924 | 4/1992 | Herbert et al. | 165/906 X |

FOREIGN PATENT DOCUMENTS

| | | | |
|---|---|---|---|
| 2614980 | 11/1988 | Italy . | |
| 247498 | 10/1990 | Japan | 165/906 |
| 577746 | 5/1946 | United Kingdom | 165/906 |
| 2082312 | 3/1982 | United Kingdom | 165/173 |

*Primary Examiner*—John Rivell
*Assistant Examiner*—L. R. Leo
*Attorney, Agent, or Firm*—Morgan & Finnegan

[57] ABSTRACT

A heat exchanger tank for connection to a header part to form a heat exchanger manifold has an elongate trough-shaped body 4 having opposed side walls 14,16; and at least one strengthening tie bar 36 extending between the side walls 14,16, the tie bar comprising an elongate body 37 having enlarged head portions 40 at opposite ends thereof which are of generally wedge-shaped section of dimension which decreases in a direction generally perpendicular to the elongate extent of the body of the tie bar, with the tank side walls 14,16 defining opposed pockets 44 for of shape which corresponds to the shape of the head portions for receiving therein respective head portions of the tie bar.

20 Claims, 4 Drawing Sheets

HEAT EXCHANGER TANK WITH TIE BAR

FIELD OF THE INVENTION

The present invention relates to a strengthening tie bar for a heat exchanger manifold end tank, to an end tank adapted to receive such a tie bar, to an end tank fitted with one or more tie bars, and to a method of assembly of such an end tank.

BACKGROUND OF THE INVENTION

Heat exchangers of the type which are employed in automobiles, for example, as charged air coolers for turbochargers, comprise a manifold in the form of separate tank and header parts which are joined together to define a manifold housing. This housing is connected to a large number of heat exchange tubes through which air to be cooled is passed. The heat exchange tubes are connected at end portions thereof to the header part.

Such manifolds are subject to expansions arising from elevated temperatures and pressures, which render them liable to failure. Conventionally, the tank parts are reinforced to resist this expansion by the provision of increased wall thickness, the addition of internal and/or external ribbing, or the addition of internal tie bars which extend between inner walls of the tank, and which are cast with the tank or are welded in position. An increase in the header material gauge may also be employed as a means of reinforcement.

There are a number of problems with these means of strengthening. The addition of extra material for strengthening adds weight and increases the cost of the tank. It also complicates the tooling, patterns, moulds etc which are required. Where internal tie bars are welded into position within the tank there is a risk of catastrophic failure should a weld joint fail or a tie bar become dislodged. Where the tie bars are cast in position, this complicates the manufacture, and may require secondary operations to complete the casting, or the use of more than one sand core. Such casting procedures also require additional cleansing in order to remove residue created during this additional casting.

It has previously been proposed in French Patent Appliation, published No. 2614980 to provide in a plastics tank a transverse generally U-shaped strengthening wire which is fitted across the tank housing, legs of which are received in bores moulded into opposite sides of the tank. It is, however, particularly difficult to locate the wires in the bores since the ends of the wires must be aligned exactly with the bores before they can be received therein. Also, although these provide a strengthening function in a plastics tank, such wires would be quite inadequate for strengthening a cast metal tank for use as a charged air cooler tank.

DISCUSSION OF THE INVENTION

An object of the invention is to provide a tie bar, a heat exchanger tank, and a tank incorporating such a tie bar which overcome the problems discussed above.

According to a first aspect of the present invention there is provided a tie bar for connection between opposed side walls of a heat exchanger tank, comprising:

an elongate body having enlarged head portions at opposite ends thereof for receipt within pockets formed in opposed tank side walls, wherein the head portions have a generally wedge-shaped section of dimension which decreases in a direction generally perpendicular to the elongate extent of the body.

The invention also resides in a heat exchanger tank for connection to a header part to form a heat exchanger manifold, said tank comprising;

an elongate trough-shaped body having opposed side walls defining opposed pockets for receiving therein portions of strengthening tie bars for fitting therein so as to extend between said side walls, said pockets being generally wedge-shaped of a dimension which decreases in a direction generally perpendicular to the direction between the opposed side walls, towards a base of the pocket.

The invention further resides in a reinforced heat exchanger tank when fitted with a reinforcing tie bar.

Use of a tie bar which is insertable into pockets on the tank overcomes the problems of formation of tie bars which are cast in position. The arrangement of head portions of wedge-shaped section, and correspondingly-shaped pockets in the tank side walls means that the tie bar can be easily located, since on fitting, a relatively small end of the head portion (i.e. the narrow end of the wedge) is required to be fitted into a relatively larger pocket opening. Thus, the tie bars are essentially self-locating. The wedge shape also allows the tie bar to be held very firmly in the pockets. Although in use the tie bars are preferably subsequently additionally welded in place, the wedge-shape arrangement ensures a significant degree of self-retention, increasing their strengthening effect.

Preferably, the head portions are of generally semicircular form viewed in the direction of elongate extent of the body.

More preferably, the head portions have a generally straight edge region constituting the straight edge of the semicircle, and a curved semicircular edge region, and decrease in thickness (as measured in the direction of elongate extent of the tie bar body) from the straight region to a portion of the semicircular region remote therefrom.

The semicircular shape provides a large surface area for the head portions, and hence for the degree of contact with a correspondingly shaped pocket in a tank part, thereby maximising the degree of self-retention, and increasing the strengthening effect.

Preferably, the side walls of the tank define pockets of corresponding wedge-shaped form to the form of the tie bar head portions between a respective inwardly facing wall portion and a lip which is disposed inwardly of said wall portion and which is abutted by a region of the body portion of the tie bar adjacent the head portion when the tie bar is fitted in place. This lip functions as a load-bearing lip.

In a preferred embodiment, the tie bar is provided at opposite ends thereof with projecting lugs which extend beyond the semicircular wedge-shape of the head portions. These are to be received within recesses defined within the side walls of the tank. Preferably, the tank has a rim at which the tank is engageable with a header part to form a manifold housing, the rim defining the notches for receiving the projecting lugs, which notches extend through the entire tank wall thickness.

This arrangement of projecting lugs and receiving notches means that when the tank and header parts are assembled, the weld material of the weld employed to join the tank and header parts contacts the projecting lugs so as to weld the tie bar in position, and obviates the need for a separate weld step for securing the tie bar.

With an embodiment of the tie bar for location at positions in the tank spaced from the rim the projecting lugs are omitted and the tie bar is fitted into the tank with the head portions engaged in the pockets, and is welded into place with a weld joint at an exposed portion of the junction between the head portion and the tank side wall.

The invention also resides in a method of assembly of a heat exchanger manifold comprising the steps of:

a) providing a heat exchanger tank comprising an elongate generally channel-shaped body having opposed side walls which define tie bar receiving pockets therein, which pockets have notches which extend through the side wall; and, providing at least one strengthening tie bar comprising an elongate body having enlarged head portions of a generally wedge-shaped section of a dimension which decreases in a direction generally perpendicular to the elongate extent of the tie bar body, and projecting lugs which project from opposite ends of the head portions said pockets having a shape which corresponds to that of the tie bar head portions, b) fitting the tie bar to the tank body so that the enlarged head portions are received, narrow end first, in the pockets, and so that the projecting lugs are received within the side wall notches; and c) welding a header part to free edges of the side wall so that the weld joint contacts the projecting lugs through the notch to thereby also weld the tie bar in place.

As previously noted, no separate weld step for securing the tie bar is required.

The invention also resides in a method of assembly of a heat exchanger manifold comprising the steps of:

a) providing a heat exchanger tank comprising an elongate generally channel-shaped body having opposed side walls which define tie bar receiving pockets therein; and, providing at least one strengthening tie bar comprising an elongate body having enlarged head portions of a generally wedge-shaped section of a dimension which decreases in a direction generally perpendicular to the elongate extent of the tie bar body, said pockets having a shape which corresponds to that of the tie bar head portions, b) fitting the tie bar to the tank body so that the enlarged head portions are received, narrow end first, in the pockets;

c) welding the tie bar in position by forming a weld joint at an exposed portion of the junction between the tie bar head portions and the tank side wall; and d) welding a header part to free edges of the side wall.

BRIEF DESCRIPTION OF THE DRAWINGS

An embodiment of the invention is described, by way of example only, with reference to the following drawings in which:

FIG. 1(*a*) is an enlarged view of a first tie bar;

FIG. 1(*b*) is an enlarged view of a second form of tie bar;

FIG. 2(*b*) is an end view of the first tie bar;

FIG. 3(*b*) is an end view of the second form of tie bar;

DESCRIPTION OF THE PREFERRED EMBODIMENT

Figure 1B:
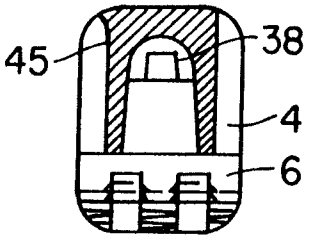
FIG. 1 is a side view of a heat exchanger manifold connected to a heat exchanger core including a tank in accordance with the invention.
Figure 1A:
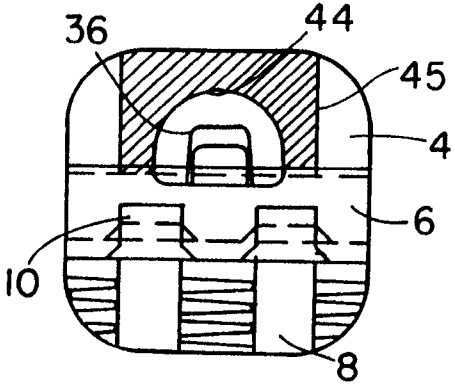
Figure 1:
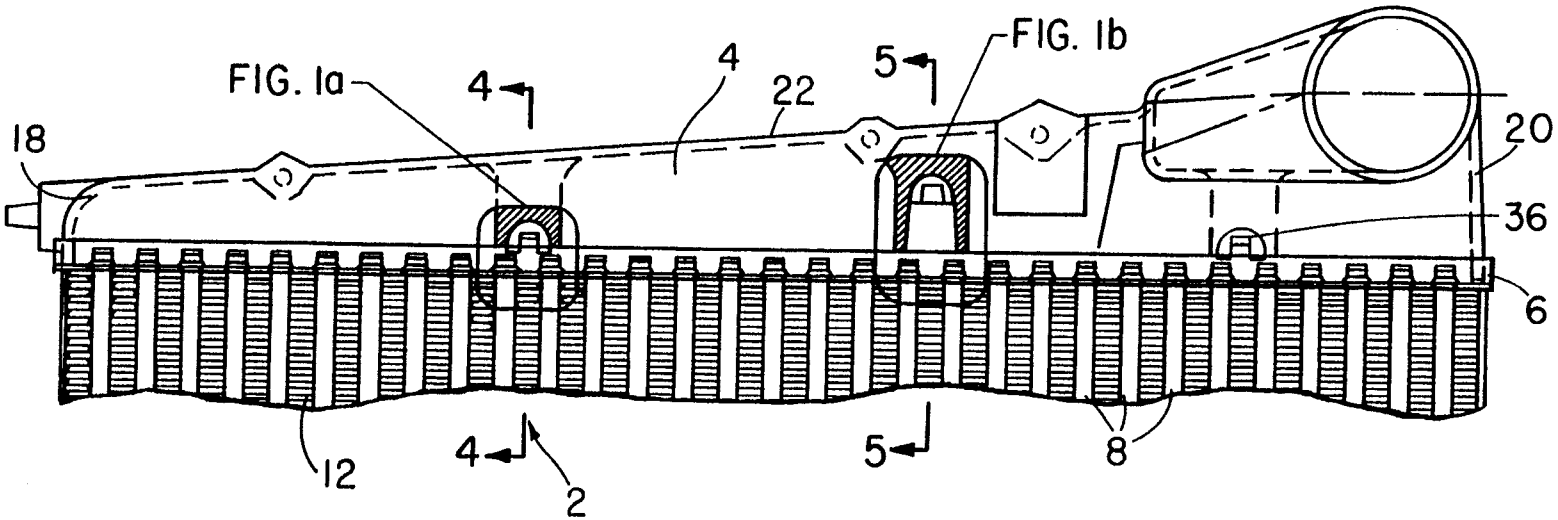

Turning to the drawings, FIG. 1 shows in side view a part of a heat exchanger generally desigated 2. The heat exchanger comprises a tank 4 secured to a header 6. The header 6 is provided with a plurality of heat exchange tubes 8, end portions 10 of which extend through apertures formed in the header part 6. Inserts 12, comprising bands of sheet metal which are curved or corrugated are located in the spaces between the heat exchange tubes 8, so as to be in thermal contact with the tubes 8.

Figure 4:
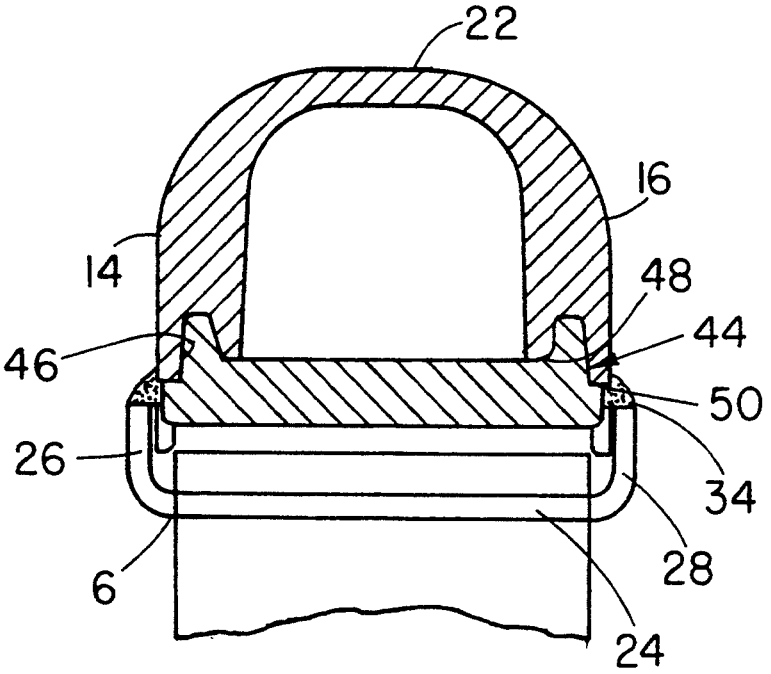
FIG. 4 is a simplified cross-sectional view taken along the line A—A of FIG. 1.

The tank 4 comprises an elongate generally channel-shaped or trough-shaped half-shell having opposed side walls 14,16 (best seen in FIGS. 4 and 5), opposed end walls 18,20 and a wall 22 referred to below as a base wall since it forms a base of the trough, although in the illustrated embodiment for use as a charged air cooler this wall is generally uppermost. The header 6 comprises an elongate channel-shaped member having a base 24 and upstanding longitudinal side walls 26,28. Outwardly facing edge regions 30,32 of the tank side walls are received within the channel of the header 6, so that inwardly facing edge regions 31,33 of the side walls 26,28 engage the edge regions 30,32. The tank and header parts are joined by a weld joint 34.

Figure 7:
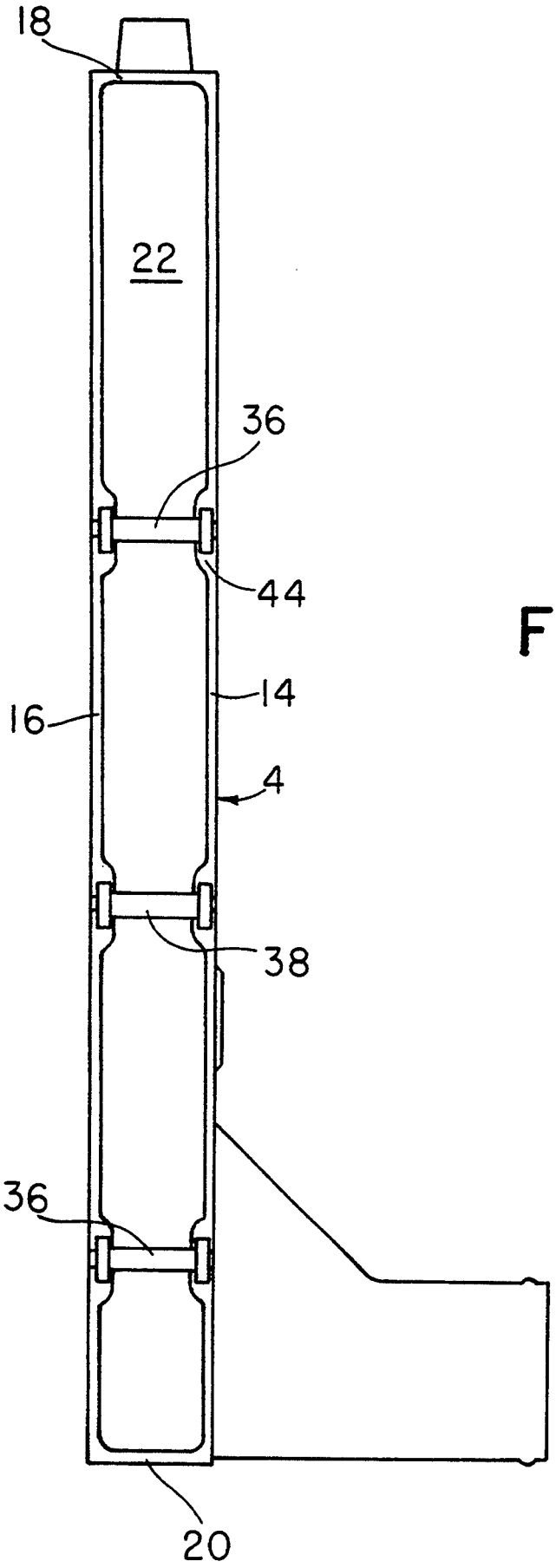
FIG. 7 is a plan view of the heat exchanger tank part with the tie bars fitted in place.

At locations within the tank, and in particular at locations which are subject to excessive stress, there are disposed reinforcing tie bars 36,38, which extend laterally across the tank. This is best seen in the view of FIG. 7 which is a view into the open channel of the tank with the tie bars fitted in place, before connection of the header. The tie bars 36 are disposed at locations adjacent the tank-header weld joint, whilst the tie bars 38 are disposed at locations spaced from this joint. Although the tank of FIG. 1 employs two tie bars of the type denoted 36 and a single tie bar of the type denoted 38, the number and location of each of these forms could be varied for particular applications of the tank.

Figure 2A:
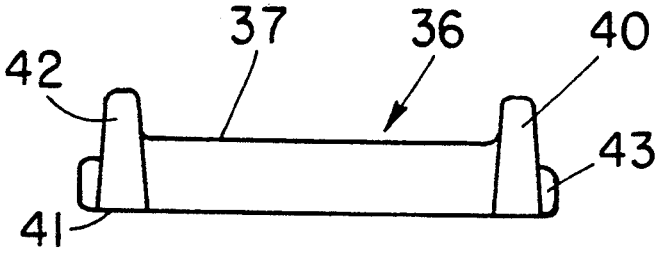
FIG. 2(*a*) is a side view of a first tie bar.
Figure 2B:
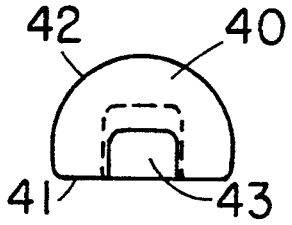
Figure 3A:
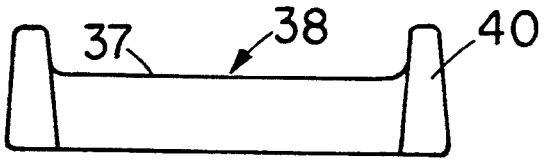
FIG. 3(*a*) is a side view of a second form of tie bar.
Figure 3B:
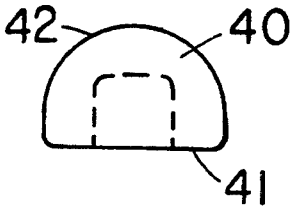

As shown in FIG. 2, a tie bar 36 comprises a straight, elongate body in the form of a shank or shaft 37 having at opposite ends thereof enlarged head portions 40. The shank cross-section which is approximately square in the illustrated embodiment may take a variety of other forms. It is important that the dimensions are sufficient so that the tie bars have the requisite strength to provide the required strengthening of the tank. The head portions are of plate-like generally semicircular form, having a straight edge region 41 and curved semicircular edge region 42. These head portions 40 are in section generally wedge-shaped, of decreasing thickness (measured in the direction of the elongate shaft 37) from the straight edge region 41 to a portion of the curved edge region 42 remote therefrom, i.e. in the direction of insertion in the pockets as discussed below. At opposite extremities of the tie bar 36 there are disposed short lugs or projections 43.

Figure 6:
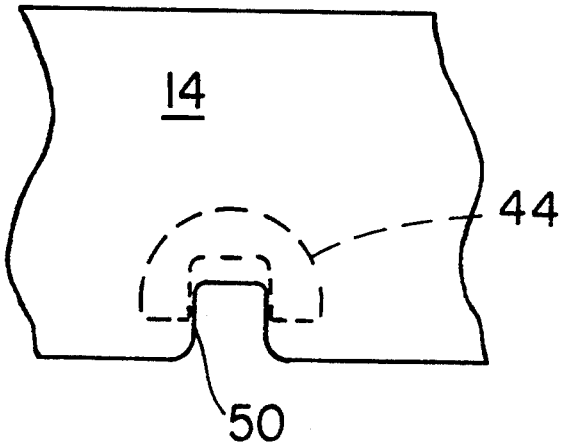
FIG. 6 is a side view of a region of the tank part only, in the vicinity of the location of the first tie bar.

The tie bar 36 is fitted within pockets 44 provided on the opposed side walls 14,16 which are shaped to receive the head portions 40. These pockets are preferably formed in regions of increased wall thickness 45. The pockets 44 comprise semicircular wedge-shaped recesses shaped to receive the head portion 40, which are defined between an external wall portion 46, and a load bearing lip 48. A receiving notch 50 extends through the walls, as seen in FIG. 6, into which the lugs or projections 43 of the tie bar 36 are received. On assembly, the tie bar 36 is fitted to the tank by arranging the tie bar 36 across the tank at the location of opposed pockets 44 and fitting this to the tank so that the wedge-shaped head portions 40 enter into the pockets 44, narrow end first. The header is then fitted over the open side of the tank part, and the weld joint 34 is created. By means of the notches 50 and projections 43, the creation of the weld joint also serves to hold the tie bar 36 in position. This avoids the need to employ an additional welding step in the assembly process.

Figure 5:
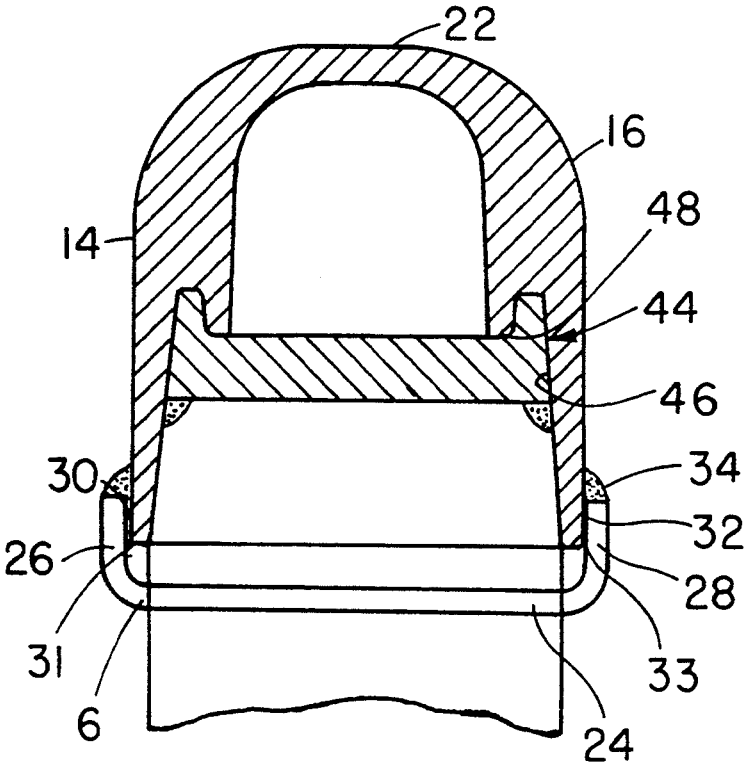
FIG. 5 is a simplified cross-sectional view taken along the line B—B of FIG. 1.

The tie bar 38 which is for location at a position spaced from the header/tank joint region, is of identical overall form to the tie bar 36, with the exception of the projections 42 which are omitted from the tie bar 38. FIG. 5 shows a pocket 44 for the tie bar 38 which is of the same form as the pocket 44 described above, except that the notches 50 are omitted. After fitting in position, this tie bar 38 is welded to the inner wall surface 46, by forming a weld joint at the exposed region 49 of the junction between the head portion and side wall.

Provision of the wedge-shaped arrangement of head portions 40 and pockets 44 means that the tie bars 36,38 are particularly easy to locate in the pockets since the initial insertion is of a relatively narrow region of the head portions 40 into a relatively wide recess. This arrangement also allows the head portions 40 of the tie bars 36,38 and recesses of the pockets 44 to be formed with relatively low tolerance since any small misorientation in surfaces of the head or recess can be accommodated. Moreover, the generally semicircular shape of the head portions 40 maximises the surfaces over which there is engagment, ensuring that the tie bars 36,38 are securely held in the recesses.

The shape of the tie bars 36,38 lends itself to manufacture in a wide variety of different lengths having identical head portions 40. Owing to the constant cross-section of the shaft portion, various lengths of tie bars 36,38 can be cast using the same head moulds, but merely interposing additional spacer plates.

The tank 4, header 6 and tie bars 36,38 are preferably formed of aluminium, although a variety of other metals or alloys could be used. It is preferable to use the same material for each of these components, so that any differences in response to thermal or pressure effects is minimised. It is also possible to apply the invention to tanks formed of plastics, for example of nylon.

What we claim is:

1. A tie bar for connection between opposed side walls of a heat exchanger tank, comprising:

an elongate body having enlarged head portions at opposite ends thereof for receipt within pockets formed in opposed tank side walls, wherein the head portions have a generally wedge-shaped section of dimension which decreases in a direction generally perpendicular to the elongate extent of the body.

2. A tie bar according to claim 1 wherein said head portions are of generally semicircular form viewed in the direction of elongate extent of the body.

3. A tie bar according to claim 2, wherein said head portions each have a generally straight edge region constituting the straight edge of the semicircle, and a semicircular edge region, and decrease in thickness, as measured in the direction of elongation, from the straight region to a portion of the semicircular region remote therefrom.

4. A tie bar according to claim 3, wherein opposite ends thereof are provided with projecting lugs extending beyond the semicircular wedge-shaped head portions.

5. A reinforced heat exchanger tank for connection to a header part to form a heat exchanger manifold, said tank comprising:

an elongate trough-shaped body having opposed side walls; and at least one strengthening tie bar extending between said side walls;

said at least one tie bar comprising an elongate body having enlarged head portions at opposite ends thereof which are of generally wedge-shaped section of dimension which decreases in a direction generally perpendicular to the elongate extent of the body of the tie bar, and said tank side walls defining opposed pockets for receiving therein respective head portions of the tie bar.

6. A heat exchanger according to claim 5, wherein the side walls define pockets of corresponding wedge-shaped form to the form of the tie bar head portions between a respective inwardly facing wall portion and a lip which is disposed inwardly of said wall portion and which is abutted by a region of the body portion of the tie bar adjacent the head portion when the tie bar is fitted in place.

7. A heat exchanger according to claim 5, wherein the head portions are of generally semicircular form viewed in the direction of the elongate extent of the tie bar body.

8. A heat exchanger tank according to claim 7, wherein said head portions each have a generally straight edge region constituting the straight edge of the semicircle, and a curved semicircular edge region, and decrease in thickness, as measured in the direction of elongation of the tie bar, from the straight region to a portion of the semicircular region remote therefrom.

9. A heat exchanger tank according to claim 8, wherein the tie bar is provided at opposite ends thereof with projecting lugs which extend beyond the semicircular wedge-shaped head portions, and wherein the pockets are provided with notches within which the projecting lugs are locatable.

10. A heat exchanger tank according to claim 9, wherein the tank defines at free edges thereof a rim at which the tank is engagable with a header part to form a manifold housing, said pockets being arranged adjacent the rim and said rim being provided with notches for receiving said projecting lugs, which notches extend through the entire thickness of the tank side wall.

11. A heat exchanger according to claim 9, wherein the tank side walls define at free edges thereof a rim at which the tank is engageable with a header part to form a manifold housing, said pockets being arranged spaced from the rim.

12. A heat exchanger tank according to claim 11, wherein said tie bar is fitted in said tank with the head portions received in said pockets, and welded into place with a weld joint at an exposed portion of the junction between each tie bar head portion and the tank side wall.

13. A heat exchanger tank for connection to a header part to form a heat exchanger manifold, said tank comprising;

an elongate trough-shaped body having opposed side walls defining opposed pockets for receiving therein portions of strengthening tie bars for fitting therein so as to extend between said side walls, said pockets being generally wedge-shaped and of a dimension which decreases in a direction generally perpendicular to the direction between the opposed side walls, towards a base of the pocket.

14. A heat exchanger tank according to claim 13 wherein the trough-shaped tank body has a basal region and side walls which extend therefrom, the pockets defined in the side walls being of generally semicircular shape of decreasing thickness as measured in the direction between the opposed side walls towards both a basal region of the tank body and the bases of the pockets.

15. A heat exchanger tank according to claim 14 wherein each pocket is defined between an inwardly facing wall portion of the side wall and a lip portion which is disposed inwardly of the wall portion.

16. A heat exchanger tank according to claim 15 wherein the pocket is arranged adjacent a free edge region of the side wall.

17. A heat exchanger tank according to claim 16 wherein a notch is formed in the side wall extending through the entire wall thickness.

18. A heat exchanger tank according to claim 15 wherein the pocket is arranged spaced from a free edge region of the side wall.

19. A method of assembly of a heat exchanger manifold comprising the steps of:

a) providing a heat exchanger tank comprising an elongate generally channel-shaped body having opposed side walls which define tie bar receiving pockets therein, which pockets have notches which extend through the side wall; and, providing at least one strengthening tie bar comprising an elongate body having enlarged head portions of a generally wedge-shaped section of a dimension which decreases in a direction generally perpendicular to the elongate extent of the tie bar body, and projecting lugs which project from opposite ends of the head portions said pockets having a shape which corresponds to that of the tie bar head portions, b) fitting the tie bar to the tank body so that the enlarged head portions are received, narrow end first, in the pockets, and so that the projecting lugs are received within the side wall notches; and c) welding a header part to free edges of the side wall so that the weld joint contacts the projecting lugs through the notch to thereby also weld the tie bar in place.

20. A method of assembly of a heat exchanger manifold comprising the steps of:

a) providing a heat exchanger tank comprising an elongate generally channel-shaped body having opposed side walls which define tie bar receiving pockets therein; and, providing at least one strengthening tie bar comprising an elongate body having enlarged head portions of a generally wedge-shaped section of a dimension which decreases in a direction generally perpendicular to the elongate extent of the tie bar body, said pockets having a shape which corresponds to that of the tie bar head portions;

b) fitting the tie bar to the tank body so that the enlarged head portions are received, narrow end first, in the pockets;

c) welding the tie bar in position by forming a weld joint at an exposed portion of the junction between the tie bar head portions and the tank side wall; and d) welding a header part to free edges of the side wall.

* * * * *

UNITED STATES PATENT AND TRADEMARK OFFICE

CERTIFICATE OF CORRECTION

PATENT NO. : 5,351,751

DATED : October 4, 1994

INVENTOR(S) : Lynn Le Roy Gage et al.

It is certified that error appears in the above-indentified patent and that said Letters Patent is hereby corrected as shown below:

COLUMN 7

Please delete Claim 17 lines 29-31 and insert therefor:

– 17. A heat exchanger tank according to claim 15 wherein the pocket is arranged spaced from a free edge region of the side wall. –

Please delete Claim 18 lines 32-34 and insert therefor:

– 18. A heat exchanger tank according to claim 16 wherein a notch is formed in the side wall extending through the entire wall thickness. –

Signed and Sealed this

Seventh Day of February, 1995

*Attest:*

Bruce Lehman

BRUCE LEHMAN

*Attesting Officer*

*Commissioner of Patents and Trademarks*